United States Patent [19]

Hilgers

[11] 4,003,069

[45] Jan. 11, 1977

[54] METHOD AND APPARATUS FOR PRODUCING A DEVELOPER MEDIUM FOR DIAZOTYPE MATERIALS

[75] Inventor: Horst Hilgers, Bad Schwalbach-Heimbach, Germany

[73] Assignee: Hoechst Aktiengesellschaft, Germany

[22] Filed: Dec. 16, 1974

[21] Appl. No.: 533,191

[30] Foreign Application Priority Data

Dec. 21, 1973 Germany ..... 2363821

[52] U.S. Cl. ..... 354/299; 34/36; 34/74; 34/155; 202/234; 203/49; 219/271; 354/300

[51] Int. Cl.² ..... G03D 13/00

[58] Field of Search ..... 354/299, 300, 297; 34/36, 74, 145, 155; 202/153, 234; 219/271, 272, 273, 275; 203/49

[56] References Cited

UNITED STATES PATENTS

| | | | |
|---|---|---|---|
| 631,461 | 8/1899 | Guillaume | 202/153 X |
| 2,096,015 | 10/1937 | Von Meister et al. | 354/300 X |
| 2,108,914 | 2/1938 | Bennett | 202/234 X |
| 2,522,529 | 9/1950 | Miller et al. | 219/275 UX |
| 3,147,687 | 9/1964 | Halden | 354/299 |

FOREIGN PATENTS OR APPLICATIONS

| | | | |
|---|---|---|---|
| 573,464 | 4/1959 | Canada | 354/300 |
| 1,096,830 | 12/1967 | United Kingdom | 354/300 |

*Primary Examiner*—Fred L. Braun
*Attorney, Agent, or Firm*—James E. Bryan

[57] ABSTRACT

An apparatus for producing a gaseous developer medium for a diazotype material from a developer solution, which apparatus comprises a vessel provided with a heater and an outlet for residual liquid, for generating a stream of vapor from a liquid, a conduit in which a stream of developer solution flowing in one general direction can come into contact with a stream of vapor flowing in the other general direction, which conduit communicates at one end with the vessel and is provided at, or in the vicinity of, the other end with an inlet for the developer solution, a condenser which communicates with the end of the conduit remote from the vessel, the condenser having an outlet for gaseous developer medium and an outlet for condensed developer medium, and a vaporizing vessel adapted to be located in a developing chamber for diazotype materials, which vaporizing vessel communicates with the outlet for condensed developer medium. The invention also relates to a process for developing diazotype material using the apparatus of the invention.

17 Claims, 1 Drawing Figure

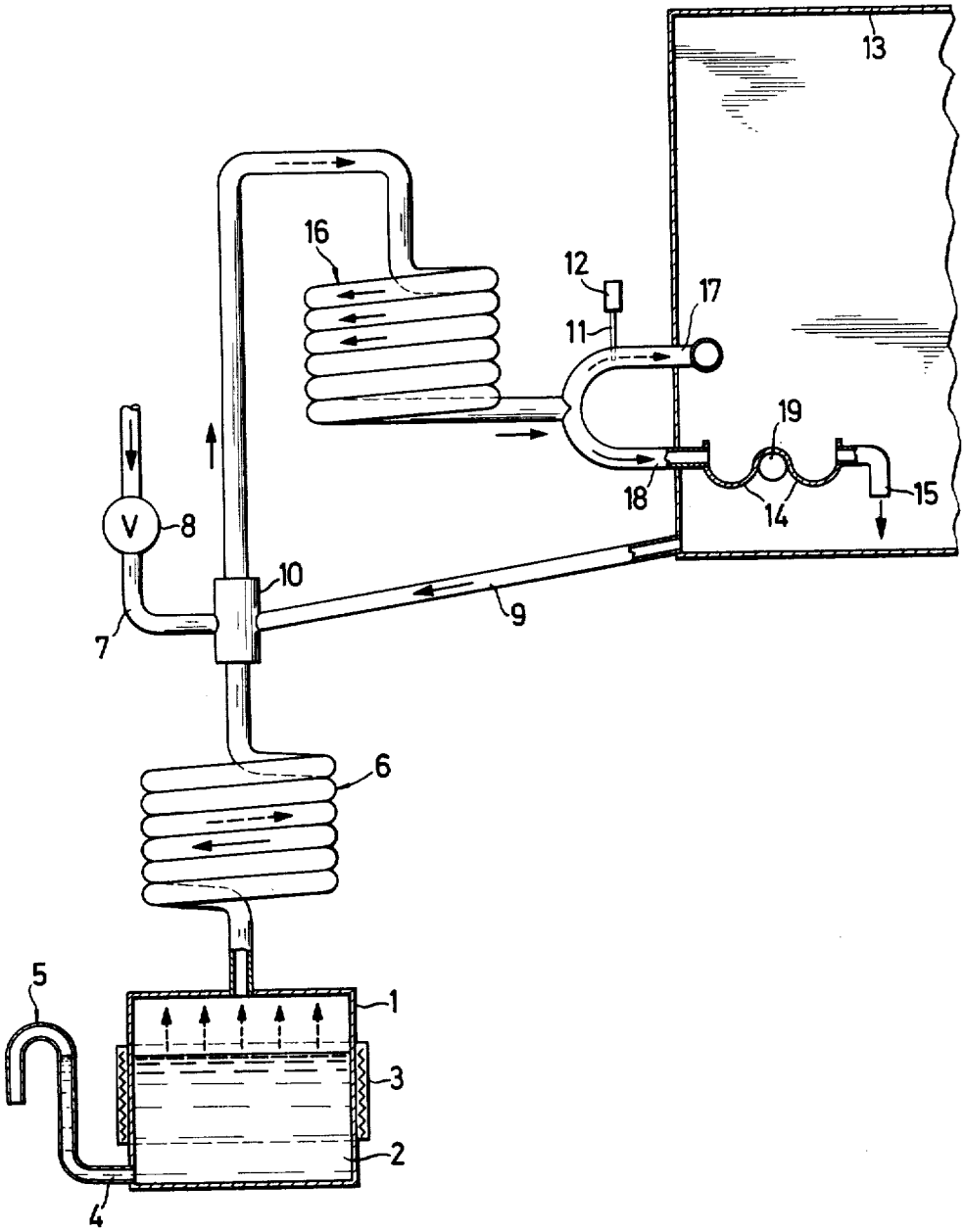
13
16
12
17
11
19
18
14
15
V
8
10
9
7
6
5
1
3
2
4

METHOD AND APPARATUS FOR PRODUCING A DEVELOPER MEDIUM FOR DIAZOTYPE MATERIALS

U.S. Pat. Application Ser. No. 395,152, filed Sept. 7, 1973, relates to a process for producing from a developer solution a gaseous developer medium for diazotype materials, which process comprises causing a stream of the developer solution flowing in one general direction to come into intimate contact with a stream of vapor flowing in the opposite general direction so that exchange of material takes place between the vapor and the developer solution to produce the gaseous developer medium. The process is preferably carried out continuously, according to the principle of continuous rectification.

The aforesaid application also relates to apparatus for carrying out the process, which apparatus may be located within or without a developing chamber for diazotype materials and comprises a vessel, provided with a heater and an outlet for the residual liquid, for producing a stream of vapor, and a conduit, following the distillation vessel, in which a stream of developer solution flowing in one general direction can come into contact with a stream of vapor flowing in the other general direction, which conduit is provided, at or in the vicinity of the end remote from the vessel, with an inlet for the developer solution and an outlet for the gaseous developer medium.

The process and apparatus of the aforesaid application make possible a good utilization of the developer solution. At the same time, residual water containing a very small amount of developer medium may be obtained and an optimum developer gas composition may be achieved. When, however, large areas of exposed material are to be developed in a short time there is some danger with the apparatus in question that the developer medium in the developing chamber may be depleted to an unacceptable extent.

The present invention provides apparatus for producing a gaseous developer medium for a diazotype material from a developer solution, which apparatus comprises a vessel, provided with a heater and an outlet for residual liquid, for generating a stream of vapor from a liquid, a conduit in which a stream of developer solution flowing in one general direction can come into contact with a stream of vapor flowing in the other general direction, which conduit communicates at one end with the vessel and is provided at, or in the vicinity of, the other end with an inlet for the developer solution, a condenser which communicates with the end of the conduit remote from the vessel, the condenser having an outlet for gaseous developer medium and an outlet for condensed developer medium, and a vaporizing vessel capable of being located in a developing chamber for diazotype materials, which vaporizing vessel communicates with the outlet for condensed developer medium.

The invention also provides a process for developing diazotype material which comprises introducing the material into a developing chamber which is provided with gaseous developer medium by causing a stream of developer solution flowing in one general direction to come into intimate contact with a stream of vapor flowing in the opposite general direction so that exchange of material takes place between the vapor and the developer solution to produce a gaseous developer medium, passing the gaseous developer medium through a condenser to condense a part thereof, passing the remaining gaseous developer medium to the developing chamber, and passing the condensed developer medium to a vaporizing vessel in the developing chamber. The developer medium is preferably produced continuously, that is, according to the principle of continuous rectification. Thus, in the process according to the invention the developer solution is advantageously counter-currently passed to a stream of vapor with intensive contact of the two phases according to the principle of continuous recitification, in the course of which material exhange takes place between the vapor and the developer solution. The two phases are said to be in intensive contact if they are thoroughly mixed and come into intimate contact with each other at all stages of the counter-current flow.

The gaseous developer medium produced according to the invention will normally be a mixture of gases, although if desired a vapor which comprises a single chemical compound could be produced. The stream of vapor will, before it contacts the developer solution, normally comprise at least one of the constituents of the developer medium, although this is not essential; thus, for example, this would not be essential in the case where the developer medium comprises a single chemical compound which is contained in the developer solution before the latter contacts the vapor. In a preferred embodiment of the invention, the vapor is produced by heating the residual liquid obtained after the developer solution has been contacted with the vapor.

The invention makes it possible to ensure that, because some developer solution is "kept in stock," there is always sufficient developer medium available in the developing chamber, even when a large amount of exposed material is developed within a short time. At the same time, the developer solution may be utilized to the optimum possible extent and, in contrast to the previously proposed vaporizers referred to in the aforementioned application, a residual water may be obtained which contains only extremely low concentrations of developer medium.

The apparatus of the invention is particularly useful for producing a developer medium which comprises an ammonia/water vapor mixture, the developer solution in this case comprising aqueous ammonia, and, in the following description, the invention is generally described with reference to such a developer medium. It will be appreciated, however, that the features described below are in general equally applicable to other developer media and the present invention is not in any way limited to the use of ammonia/water vapor mixtures.

When developing with ammonia, the developer medium is preferably an ammonia gas/water vapor mixture since water vapor accelerates the development. It is thus not necessary to separate the aqueous ammonia into ammonia gas and the higher-boiling water, although complate separation could be effected if this were necessary; instead the developer solution is separated into an ammonia gas/water vapor mixture of optimum composition for the development of diazotype materials and so-called residual water which retains only minimal amounts of ammonia. Using the vaporizer according to the inventionn it may be possible to arrive at a situation where the ammonia content of this residual water is as little as 100 ppm or less.

In the apparatus of the aforementioned application and in the apparatus according to the present invention, this optimum separation may be achieved by adding the aqueous ammonia dropwise at the head of the rectification conduit and passing it as a stream of liquid counter-currently to the stream of vapor which rises from the distillation vessel with intensive contact of the two phases, so that material exchange takes place between the vapor and the developer solution. A part of the aqueous ammonia which is added dropwise is vaporized, the lower-boiling ammonia being vaporized to a considerably greater degree than the water, so that ammonia is concentrated to a greater extent in the vapor than in the non-vaporized part of the liquid which continues to flow downwards. This vaporized part of the aqueous ammonia leaves the rectification conduit via the conduit head.

In accordance with the amount of heat which was required to liberate the vaporized part from the aqueous ammonia, part of the ascending vapor is condensed, the condensate being predominantly composed of the less volatile water. The resulting condensate, together with the aqueous ammonia which has not been vaporized, flows downwards in the conduit counter-currently to the water vapor ascending from the distillation vessel. In the course of the counter-current flow, a condensate enriched in water and a vapor enriched with ammonia are formed in accordance with the heat exchange between the two phases. From the distillation vessel to the conduit head the stream of vapor shows progressive enrichment in ammonia while in the opposite direction the condensate shows progressive depletion of ammonia, so that the water present in the distillation vessel retains hardly any ammonia. With five to six theoretical plates in the rectification conduit or column, a residual water with, for example, an ammonia content of 100 ppm may be obtained.

Different amounts of developer gas per unit time are frequently required for developing. In the apparatus described and claimed in the aforesaid application, the amount of developer gas generated per unit time in the vaporizer, that is to say the output of the vaporizer, may be regulated by different feed rates of developer solution. However, if large areas of material are to be developed or if the speed of passage is increased, regulating in this way can lead to a temporary depletion of developer medium, in particular to a depletion of water vapor. In order to substantially overcome this disadvantage, the ammonia gas/water vapor mixture leaving the rectification conduit in the apparatus of the invention does not pass directly into the gas space of the developing chamber. Rather, it is first passed through a condenser, so that part of the developer gas condenses. Only then does the developer medium pass into the gas space of the developing chamber, the condensed developer gas also being fed to the developing chamber. There is a suggestion in the aforementioned application that a condenser be connected to the rectification conduit in order to increase the reflux in the conduit. However, there is no suggestion in that application that the condensed developer gas be fed to the developing chamber.

In the apparatus of the invention, a temperature probe and a temperature controller at which the desired temperature of the developer gas is set and which accordingly controls the heating of the distillation flask, are preferably fitted adjacent the outlet orifice through which the developer gas leaves the condenser. The composition of the ammonia gas/water vapor mixture is determined by the temperature prevailing at this outlet.

The condenser is preferably a descending, air-cooled tube in the form of a coil. The aqueous ammonia condensed in the condenser is passed into an open vaporizing vessel, preferably a double channel. The condensed aqueous ammonia passes through the double channel, an ammonia gas/water vapor mixture being liberated into the developing chamber in accordance with the temperature prevailing in the double channel and the residence time therein. The aqueous ammonia which is not vaporized in the double channel leaves the double channel via an outlet and is fed back to the conduit head.

Because the developer gas is partially condensed in the condenser and the condensed aqueous ammonia is passed through the developing chamber, a depletion of developer medium, in particular a depletion of moisture, in the developing chamber can be substantially avoided, even when large areas of exposed diazotype material are to be developed within a short time.

The vaporizer according to the invention may be located within or without the developing chamber. Arguments in favor of location outside the developing chamber are easy accessibility and hence simpler servicing of the vaporizer. For thermal and process engineering reasons, however, it may be advantageous to locate the vaporizer partially or completely in the developing chamber. The rectification conduit or column of the vaporizer may be, for example, a column with stepwise separation and fixed plates, a packed column in which continuous separation may take place, or a column in the form of a coil.

The developer gas condensed on the colder parts of the developing chamber may be fed back to the rectification conduit in the same way as the aqueous ammonia which has not vaporized from the double channels. In this way, the descending stream of liquid within the rectification conduit may be increased. The descending stream of liquid can be still further increased by the rectification conduit being only partially heat-insulated or not heat-insulated at all so that a condensate forms additionally at the parts of the conduit shell which are not heat-insulated.

The invention will now be described, by way of example only, with reference to the accompanying drawing which is a view, partly in cross-section, of an apparatus constructed in accordance with the invention.

Referring now to the drawing, a distillation vessel or flask 1 contains water 2, which is practically free from ammonia, as a so-called sump. The water can be vaporized by means of a heater 3 and an ascending stream of vapor is thus produced. The distillation flask 1 is provided with an overflow 4 for the water, this overflow being constructed as a syphon 5 in order to produce a gas-tight seal between the distillation flask 1 and the exterior. The distillation flask 1 communicates with a rectification conduit or columnn 6 in the form of a coil. An inlet pipe 7 for aqueous ammonia is located at the head of the rectification column 6, and the amount of aqueous ammonia introduced per unit time into the column 6 can be regulated with the aid of a valve 8 on the inlet pipe 7. At the head of the rectification column 6 there is also an inlet pipe 9 for the condensate of developer gas which has formed on the colder parts of the developing chamber 13 (see below) and for the aqueous ammonia which has not been vaporized and which leaves the double channel 14 via its outlet 15 (see below). An outlet 10 for the developer gas liberated is also provided at the head of the column 6.

The developer gas liberated in the column 6 is passed via the outlet 10 into a descending condenser 16, which is also in the form of a coil and where part of the developer gas condenses. The developer gas leaving the condenser 16 passes into a developing chamber 13 via an outlet pipe 17. The condensed developer gas passes, via an outlet pipe 18, into a double channel 14, to which a heating tube 19 is fitted. The heater 3 at the distillation flask 1 is controlled by means of a temperature probe 11 and a temperature controller 12 which are fitted in the outlet pipe 17.

As as already been indicated above, water vapor which is almost free from ammonia is produced in the distillation flask 1 and flows, in the rectification column 6 which is shaped as a coil, counter-currently to the aqueous ammonia which is flowing downwards. Due to the mass transfer between the vapor and the liquid and the very different volatilities of ammonia and water, a developer gas enriched with ammonia issues from the outlet 10 while water which is almost free from ammonia passes into the distillation flask 1. The developer gas which leaves the column 6 via the outlet 10 then flows through the condenser 16, which in the illustrated embodiment is cooled only by the surrounding air. In the course of flowing through the condenser, part of the developer gas condenses. The condensed part is enriched with water compared with the uncondensed developer gas leaving the condenser 16.

The developer gas condensed in condenser 16 leaves the condenser via the outlet pipe 18. The outlet pipe 18 of the condenser 16 joins one end of the double channel 14, which is U-shaped, and an outlet 15 is located at the other end of the double channel. The part of the developer gas condensed in the condenser flows through the entire length of the double channel before it is again fed, via the outlet 15, to the inlet pipe 9 at the head of the rectification column 6. Ammonia and water vaporize in accordance with the temperature prevailing in the double channel 14. The double channel 14 together with the aqueous ammonia which flows through it forms a reservoir of developer medium which substantially prevents a depletion of developer medium in the developing chamber 13 if large areas of material are developed per unit time.

It will be obvious to those skilled in the art that many modifications may be made within the scope of the present invention without departing from the spirit thereof, and the invention includes all such modifications.

What is claimed is:

1. An apparatus for producing a gaseous developer medium for a diazotype material from a developer solution, which apparatus comprises a vessel means, provided with a heater and an outlet for residual liquid, for generating a stream of vapor from a liquid, conduit means in which a stream of developer solution flowing in one general direction can come into contact with a stream of vapor flowing in the other general direction, which conduit means communicates at one end with the vessel and is provided at, or in the vicinity of, the other end with an inlet for the developer solution, condenser means which communicates with the end of the conduit remote from the vessel, the condenser means having an outlet for gaseous developer medium and an outlet for condensed developer medium, and a vaporizing vessel means adapted to be located in a developing chamber for diazotype materials, which vaporizing vessel means communicates with the outlet for condensed developer medium.

2. An apparatus as claimed in claim 1 wherein the conduit means comprises a column in which spaced plates are fixed.

3. An apparatus as claimed in claim 1 wherein the conduit means includes a column filled with packings.

4. An apparatus as claimed in claim 1 wherein the conduit means comprises a column in the form of a coil.

5. An apparatus as claimed in claim 1 including an inlet for introducing into the conduit means any developer medium which condenses in the developing chamber.

6. An apparatus as claimed in claim 1 wherein the outlet of the vessel for residual liquid comprises a syphon.

7. An apparatus as claimed in claim 1 which is located outside a developing chamber for diazotype materials.

8. An apparatus as claimed in claim 1 which is located at least partially inside a developing chamber for diazotype materials.

9. An apparatus as claimed in claim 1 including a temperature probe in the region of the outlet of the condeser means for gaseous developer medium which temperature probe is connected to a temperature controller whereby the temperature in the vessel for generating the stream of vapor can be adjusted.

10. An apparatus as claimed in claim 1 wherein the vaporizing vessel means which communicates with the condenser means also communicates with the end of the conduit remote from the vessel.

11. An apparatus as claimed in claim 1 wherein the condenser means is an air-cooled tube in the form of a coil and wherein the developer medium can be passed downwards through the coil.

12. An apparatus as claimed in claim 1 wherein the vaporizing vessel means which communicates with the outlet for condensed developer medium is a double channel so arranged that condensed developer medium flows into it at one end and out through an outlet at the other end.

13. A device for vaporizing developer medium from a developer solution for developing apparatus for diazotype materials, having distillation flask means for generating a stream of vapor, the flask means being provided with a heater and an outlet for residual water, rectification column means connected to the distillation flask means, the column means being provided with an inlet for the developer solution, located at the column head or in the vicinity of the column head, and an outlet for the gaseous developer medium, located at the column head or in the vicinity of the column head, condenser means connected to the rectification column means at the outlet for the gaseous developer medium for condensation of a part of the gaseous developer medium, the condensor means having an outlet orifice for the gaseous developer medium, and an outlet for the condensed developer medium, and vaporizing means located in a developing chamber having an outlet for residual condensed developer medium.

14. A process for developing diazotype material in a developing chamber which is provided with gaseous developer medium comprising the steps of causing a stream of developer solution flowing in one general direction to come into intimate contact with a stream of vapor flowing in the opposite general direction so that exchange of material takes place between the vapor and the developer solution to produce a gaseous developer medium, passing the gaseous developer medium through a condenser to condense a part thereof, passing the remaining gaseous developer medium to the developing chamber, and passing the condensed developer medium to a vaporizing vessel in the developing chamber.

15. A process as claimed in claim 14 which is carried out continuously.

16. A process as claimed in claim 15 wherein the developer solution partly comprises condensate from the developing chamber.

17. A process as claimed in claim 15 wherein the gaseous developer medium comprises a mixture of ammonia and water vapor.

* * * * *